United States Patent [19]

Castelli et al.

[11] 4,045,788

[45] Aug. 30, 1977

[54] ALLPURPOSE PORTABLE SCOREBOARD

[75] Inventors: Joseph T. Castelli; Joseph J. Forrester, both of Pittsburgh; Stephen Symosko, McDonald, all of Pa.

[73] Assignee: Instrument Services, Inc., Bridgeville, Pa.

[21] Appl. No.: 680,962

[22] Filed: Apr. 27, 1976

[51] Int. Cl.[2] ..... G08B 23/00

[52] U.S. Cl. ..... 340/323 R; 340/309.2

[58] Field of Search ..... 340/323

[56] References Cited

U.S. PATENT DOCUMENTS

| | | | |
|---|---|---|---|
| 2,348,431 | 5/1944 | Warmey | 340/323 |
| 2,513,623 | 7/1950 | Bray | 340/323 |
| 3,981,002 | 9/1976 | Gardner | 340/323 |

*Primary Examiner*—Thomas B. Habecker

*Attorney, Agent, or Firm*—Robert D. Yeager; Howard G. Massung

[57] ABSTRACT

A portable self-contained scoreboard adaptable for use with a variety of different sports. The self-contained scoreboard has a plurality of variable numeral displays. Some of the numeral displays are constructed to function as a controllable clock which can count up or count down. The clock numerals can also be manually controlled to be used to indicate other desired information. A plurality of descriptive placards are provided with the self-contained portable scoreboard. The placards are constructed to be attachable to the face of the scoreboard. Selected placards can be attached to the scoreboard to render the scoreboard face applicable for scoring a variety of sports. The numeral and indicator light controls are then selected to be in accordance with the placard modified scoreboard face for use with the desired sport. This permits the scoreboard to be adaptable for use with a wide variety of sporting events. A pair of indicating timers adapted for use with the scoreboard can also be provided. This pair of timers is adjustable to count automatically from 1 to 99 seconds for use as shot timers or game delay timers. The scoreboard is operable from a conventional 120 volt AC supply or from a portable gasoline generator. A brightness control is provided for changing the intensity of the number shown on the numeral displays. When the scoreboard is used outdoors, the brightness is increased to enhance visibility of the displays.

18 Claims, 23 Drawing Figures

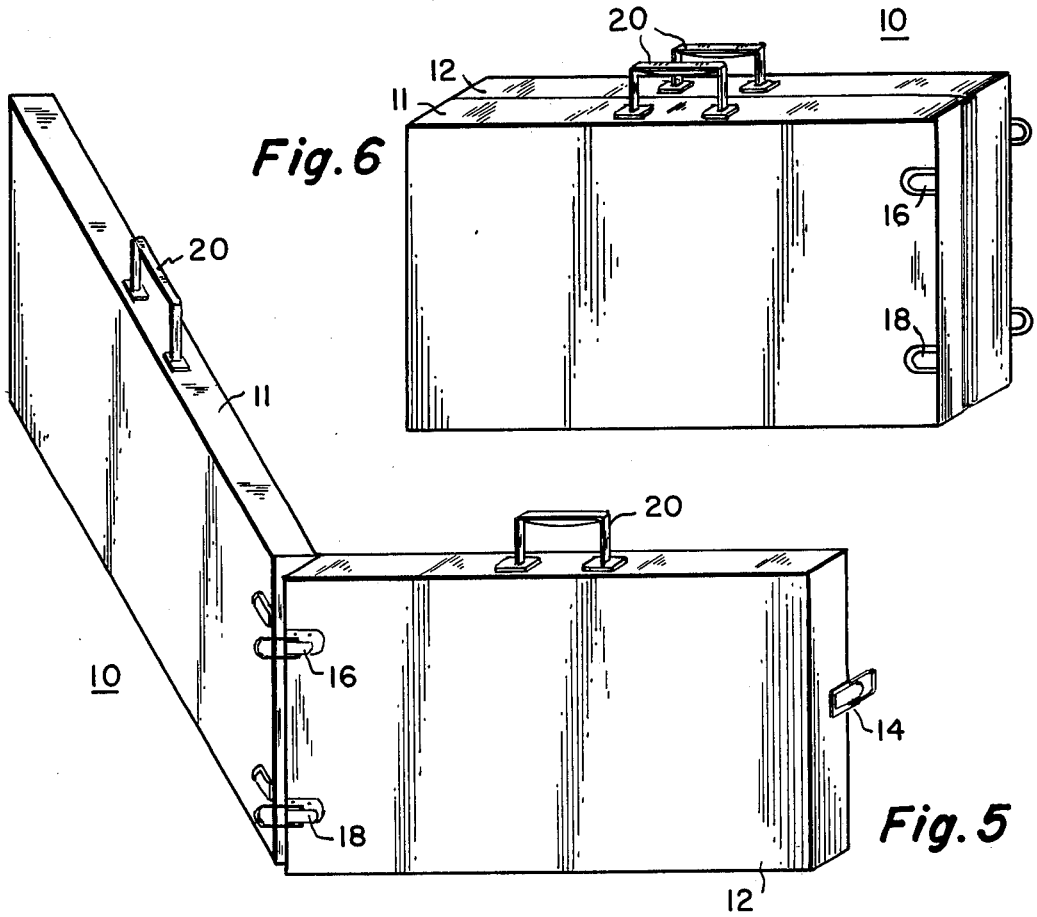
Fig. 6
Fig. 5
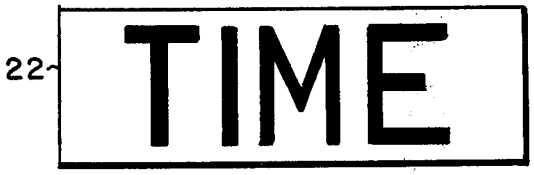
Fig. 7
Fig. 8
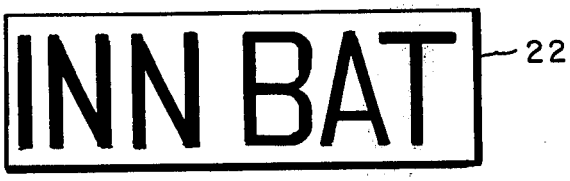
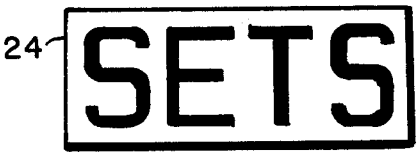
Fig. 9

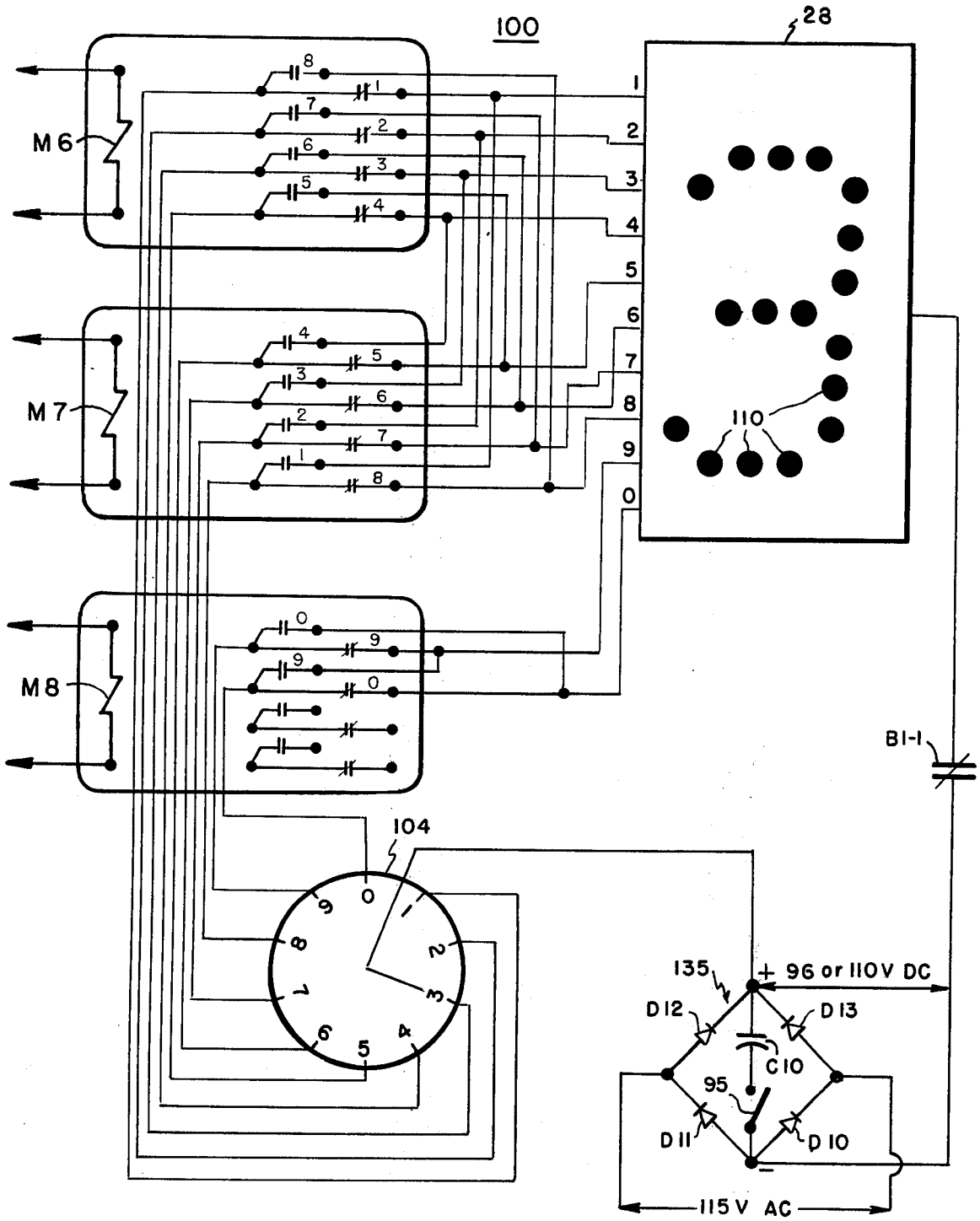
Fig. 21
Fig. 22
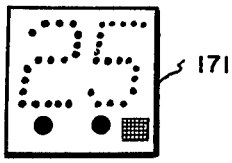

ALLPURPOSE PORTABLE SCOREBOARD

BACKGROUND OF THE INVENTION

1. Field of the Invention

This invention relates to scoreboards and more particularly to an all purpose portable self-contained scoreboard adaptable for scoring a variety of sporting events.

2. Description of the Prior Art

Prior art scoreboards are usually constructed for scoring a selected sport and are not readily adaptable for scoring other sports. They are usually permanently mounted in the location where they are to be used and cannot easily be moved to other areas. With the great increase in the type and number of sporting events being offered by schools, adequate score keeping facilities become a problem. It is desirable to have a scoreboard which can easily be moved to different locations. It is also desirable that the scoreboard be versatile enough to score many different sporting events.

SUMMARY OF THE INVENTION

A portable self-contained scoreboard having a face with a plurality of variable numeral displays which are usable in conjunction with a plurality of placards, having descriptive information thereon, to be suitable for use with a variety of sporting events. Some of the variable numerals are adaptable for either manual control or control as an event timer, in response to a self-contained clock circuit. The clock circuit can count the controlled numerals either up or down, as desired. The portable scoreboard also contains a plurality of indicator lights which can be utilized for indicating other items of interest in the sporting event. Some of the numerals can be controlled either manually or in response to a clock.

A short period timer, adjustable from 1 to 99 seconds, is also provided. The timer can be automatically reset to the beginning of the set timer period by a reset button. This short period timer is desirable for scoring events requiring an action within a predetermined time, such as basketball or football. The period over which the timer operates is adjustable on the face of the timer. In football, for example, it can be used as a 25 second game delay clock. The short period timer can also be operated manually to indicate other pertinent information such as "HITS" or "YARDS TO GO".

Each self-contained portable scoreboard includes a set of attachable placards which can be attached to the scoreboard face to render the scoreboard usable for different sports such as baseball, basketball, football, hockey, track, swimming or wrestling depending on the placard attached. The selected placards provide descriptive information rendering the scoreboard usable for the selected sport. In addition, the placards can identify and reveal selected indicator lights used in conjunction with the appropriate sport to indicate events of interest. The portable scoreboard is operable from alternating current, such as standard 120 volts AC.

The indications on the scoreboard are controlled from a control box. The scoreboard timer can be controlled by a separate activator. The activator can be connected by wires to the control box or alternate control can be through a remote transmitter and a receiver. Remote transmitter control can be desirable in a sport such as football where the official time is kept by a referee on the field. The scoreboard is self-contained and portable as a unit. The placards, control box, and control cable can all be stored in the scoreboard compartments for transporting. In one embodiment of the invention the scoreboard utilizes two rectangular scoreboard face portions, connected on one edge. The portions fold into close proximity forming a convenient transporting and storage case. When opened, the two units swing away from each other around the common hinge providing a scoreboard having a relatively wide face. When the scoreboard is opened, the two units are swung around the common hinge until their edges abut. They are then locked rigidly in this position by fasteners. A large placard is then mounted on top of the scoreboard. The brightness of the indicating lights which form the displayed numerals, can be increased for outside use. The intensity of the numerals is thus bright enough to be visible in sunny surroundings.

It is an object of this invention to teach a portable scoreboard having a plurality of variable numerals being adaptable through placards containing descriptive information thereon for use in scoring a variety of sports.

It is another object of this invention to teach a portable scoreboard having variable numerals thereon which can be connected to respond to a clock to time up or time down and also can be operable manually when appropriate.

It is a further object of this invention to teach an all purpose portable scoreboard having brightness control of the displayed numbers and indicating lights.

It is a further object of this invention to teach a remote controller for controlling start-stop operation of the clock on the portable scoreboard.

It is yet a further object of this invention to teach a short interval adjustable digital timer for use as a shot timer, a game delay timer, or for additional event information.

BRIEF DESCRIPTION OF THE DRAWINGS

For a better understanding of the invention, reference may be had to the preferred embodiments exemplary of the invention shown in the accompanying drawings, in which:

FIG. 5 is a back view of the scoreboard in the partially open position;

FIG. 6 is a view of the portable scoreboard in the closed position for transportation or storage;

FIGS. 7 through 16 are views of various placards used for adapting the disclosed scoreboard to a variety of sports;

FIG. 21 is a schematic of the display circuit utilized for activating each variable clock numeral; and, FIG. 22 is a front view of the adjustable short period timer; and, FIG. 23 is a schematic of the pulse clock circuit for use with the disclosed portable scoreboard.

DESCRIPTION OF THE PREFERRED EMBODIMENTS

Figure 1:
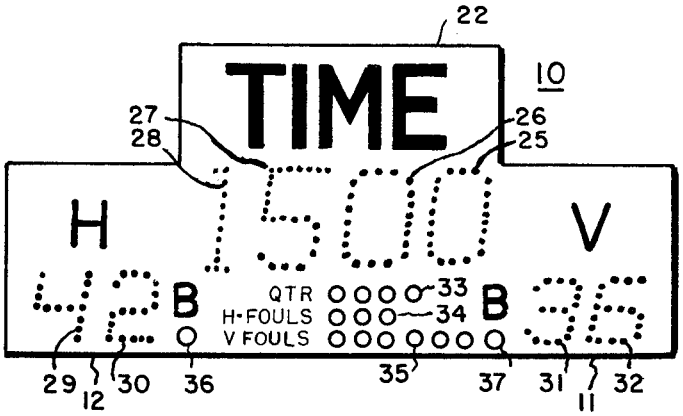
FIG. 1 is a view of the portable scoreboard adapted for scoring basketball or wrestling.

Referring now to the drawings and FIGS. 1 through 6 in particular, there is shown a self-contained portable scoreboard 10 utilizing the teaching of the present invention.

Figure 2:
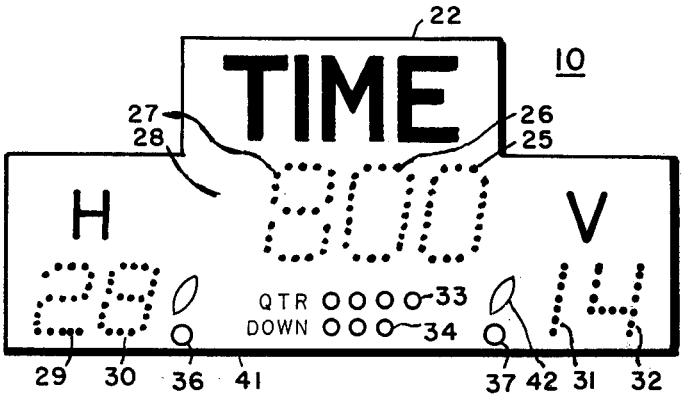
FIG. 2 is a view of the disclosed scoreboard adaptable for use in scoring football or soccer.
Figure 3:
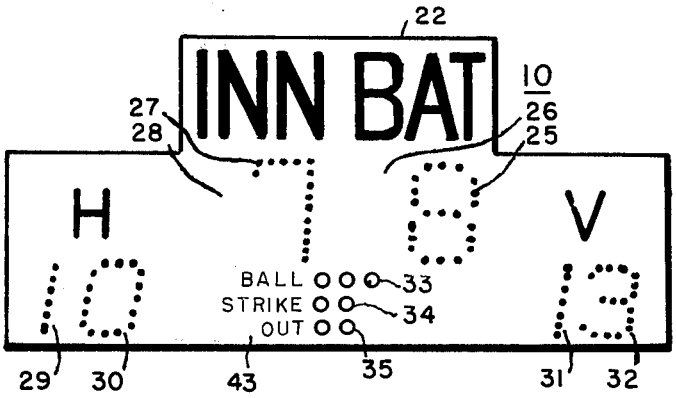
FIG. 3 is a view of the portable scoreboard adaptable for scoring baseball or softball.
Figure 4:
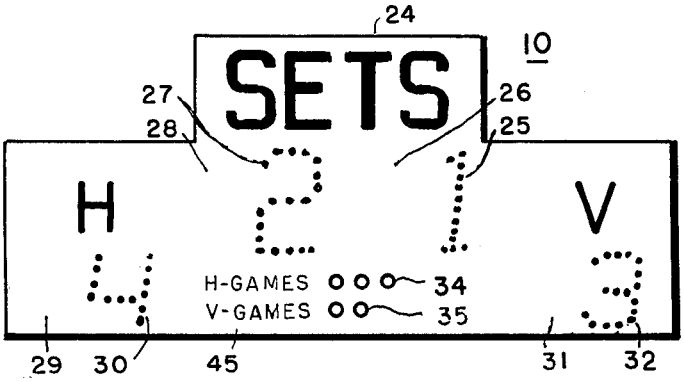
FIG. 4 is a view of the portable scoreboard adaptable for scoring tennis.

Scoreboard 10 comprises two units 11 and 12, hinged at one edge, which can be swung open to form a generally rectangular scoreboard face. Units 11 and 12 are hinged at one front edge and are pivotable around the hinge to an open position forming the scoreboard face. When units 11 and 12 are in the open position their side edges are abutting. Latches 16 and 18 are provided on the backs of units 11 and 12 for rigidly securing the units 11 and 12 in the open position. Latch 14 is provided for locking the unit in the closed position wherein the faces of scoreboard 11 and 12 are in juxtaposition for easy transporting or storage. Handles 20 are provided on units 11 and 12 to facilitate carrying. When it is desired to use scoreboard 10, units 11 and 12 are swung to the open position and latches 16 and 18 are engaged holding units 11 and 12 in rigid alignment providing a flat scoreboard face. When the scoreboard is in the open position a large placard 22, shown in FIG. 7, is mounted on top of units 11 and 12 forming a part of the scoreboard face. As shown in FIGS. 1 through 4 with the scoreboard in the open position, a variety of sporting events can be scored. Main center placard 22 provided for the scoreboard 10, has printed information on both sides. One side of placard 22 shown in FIG. 7 indicates time and is used when numeral displays 25, 26, 27 and 28 are controlled by a clock circuit. The other side of placard 22, shown in FIG. 8 indicates the inning and the batter and at this time the numeral displays 25, 26, 27 and 28 are manually controlled. When used for other sports, such as, tennis for example, as shown in FIG. 4 an additional placard such as 24 can be provided over the time indication. As shown in FIG. 1 through 4, four numeral displays 25, 26, 27 and 28 are provided in the center of the scoreboard 10. These numeral indications 25 through 28 can be individually controlled or operate in response to a clock. When numerals 25 through 28 are controlled in response to a clock, they can count sequentially either up or down. That is, they can provide an indication of remaining time, for sports such as basketball and football or elapsed time, for sports such as swimming or track. A pair of numerals 29 and 30, or 31 and 32 are provided on either end of scoreboard 10. These numerals are manually controlled to indicate the scores of the competing teams. H for home team is provided above numeral displays 29 and 30 and V for visiting team is provided above numeral displays 31 and 32. Each numeral 25 through 32 consists of an array of lights which are selectively activated to form the desired number. When the center numeral indicators 25 through 28 are manually controlled, a black out switch is provided for turning off numerals 26 and 28. These numerals 26 and 28 can be turned off whenever they are not pertinent to the event, such as with baseball.

Portable scoreboard 10 can be closed as shown in FIG. 6 with the placard stored therein to form a convenient transporting or storage case. Compartments are provided in the scoreboard for storing the scoreboard control box 50, shown in FIG. 18, and associated control cable as well as the various placards; extension cords and removable hooks used for mounting. Handles 20 facilitate movement of the portable scoreboard 10. The portable scoreboard weighs less than 70 pounds and can easily be moved. The portable scoreboard thus converts from a unit 2 foot high by 3½ foot wide and 7 inches deep in the closed position to a unit 3½ 1 foot high by 7 foot wide by 3½ inches deep in the open position.

A plurality of indicator lights 33 through 37 are formed on the face of scoreboard 10. Depending on the sport for which scoreboard 10 is being utilized some of the indicator lights can be covered or not lit. Also, the descriptive placard shown in FIGS. 10 through 15 can indicate different meanings for the lights 33 through 37 depending on the sport. For example, in FIG. 1 the scoreboard is shown for scoring an event such as basketball. This shows the basic scoreboard face with no placards other than the main top placard 22 provided. Indicator lights 33 are utilized for indicating quarter, indicator lights 34 for home team fouls, indicator lights 35 for visiting team fouls and indicator lights 36 and 37 for the applicability of a bonus. In FIG. 2 the scoreboard is shown for scoring a sporting event such as football.

Figure 10:
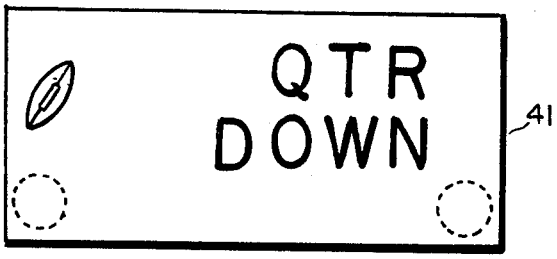
Figure 11:
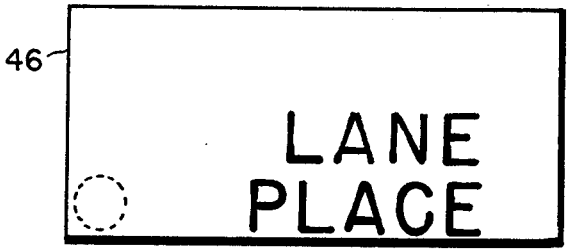
Figure 12:
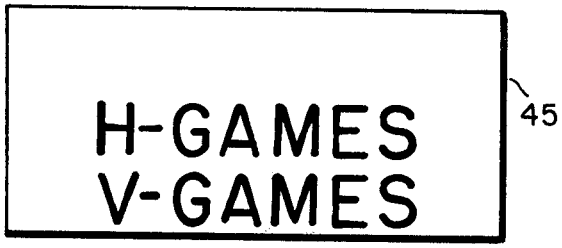
Figure 13:
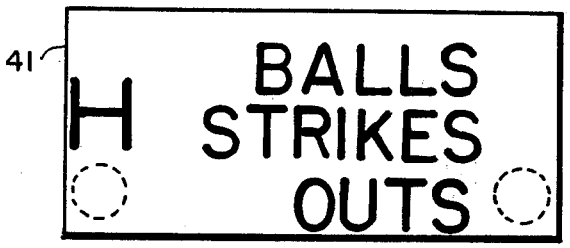
Figure 14:
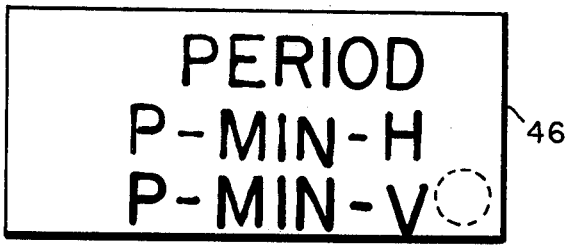
Figure 15:
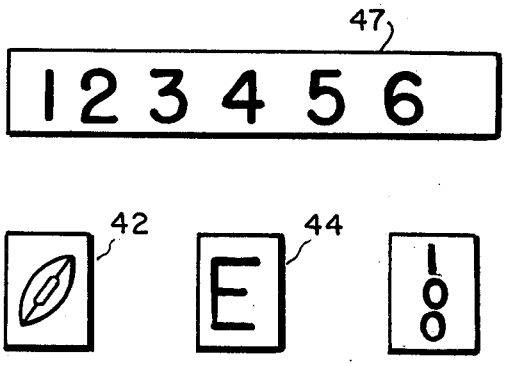
Figure 16:
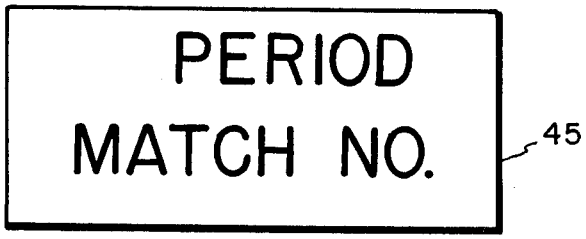

In scoring football indicator lights 33 are used for showing the quarter, lights 34 the down, and lights 36 and 37 possession. Placard 41 shown in FIG. 10 and FIG. 13 is applied to the scoreboard face as shown in FIG. 2 for football and FIG. 3 for baseball. Placard 42 as shown in FIG. 15 is utilized above the bonus, B, indication for use in football. Bonus lights 36 and 37, when used for football, then are used to indicate possession. In FIG. 3 the portable scoreboard 10 is shown utilized for scoring baseball or softball and the numeral displays 25 through 32 are used for indicating home and visitor score, the inning, and the batter. For baseball, numeral displays 25 through 28 are manually controlled. When manually controlled numeral displays 26 and 28 may be blacked out when not needed. Placard 41 is utilized so that indicator lights 33, 34 and 35 indicate balls, strikes and outs, respectively. One bonus light has the heading H to indicate a hit while a placard 44, as shown in FIG. 15, is applied over the other bonus light to be used to indicate an error. For tennis, placard 24 shown in FIG. 9 is disposed over the TIME indication and is utilized in conjunction with lights 34 and 35 which indicate home and visitors games. Placard 46 as shown in FIG. 11 can be used in conjunction with placard 47 shown in FIG. 15 to score swimming or track. The other side of placard 46 shown in FIG. 14 can be used for scoring hockey. The side of placard 45 shown in FIG. 16 can be used for wrestling. Thus, it can be seen depending on the sport to be scored, the indicator lights 33 through 37 can have different meanings. The meaning of the indicator lights 33 through 37 can be determined from their descriptive label which can be changed or altered by the appropriate placard.

Scoreboard 10 is provided with numerals 25, 26, 27 and 28 which can be controlled either manually or as a function of time. It can be used to time up where elapsed time is an important criteria for an event, such as swimming or track, or to time down, where remaining time is the controlling criteria for the event such as basketball or football. In addition, numerals 25, 26, 27 and 28 are also controllable manually to indicate other data. In FIG. 3, numerals 25 through 28 are controlled manually and are used to indicate the inning and the player at bat while in FIGS. 1 and 2 numerals 25 through 28 are controlled by a clock and are used to indicate the remaining time.

Figure 17:
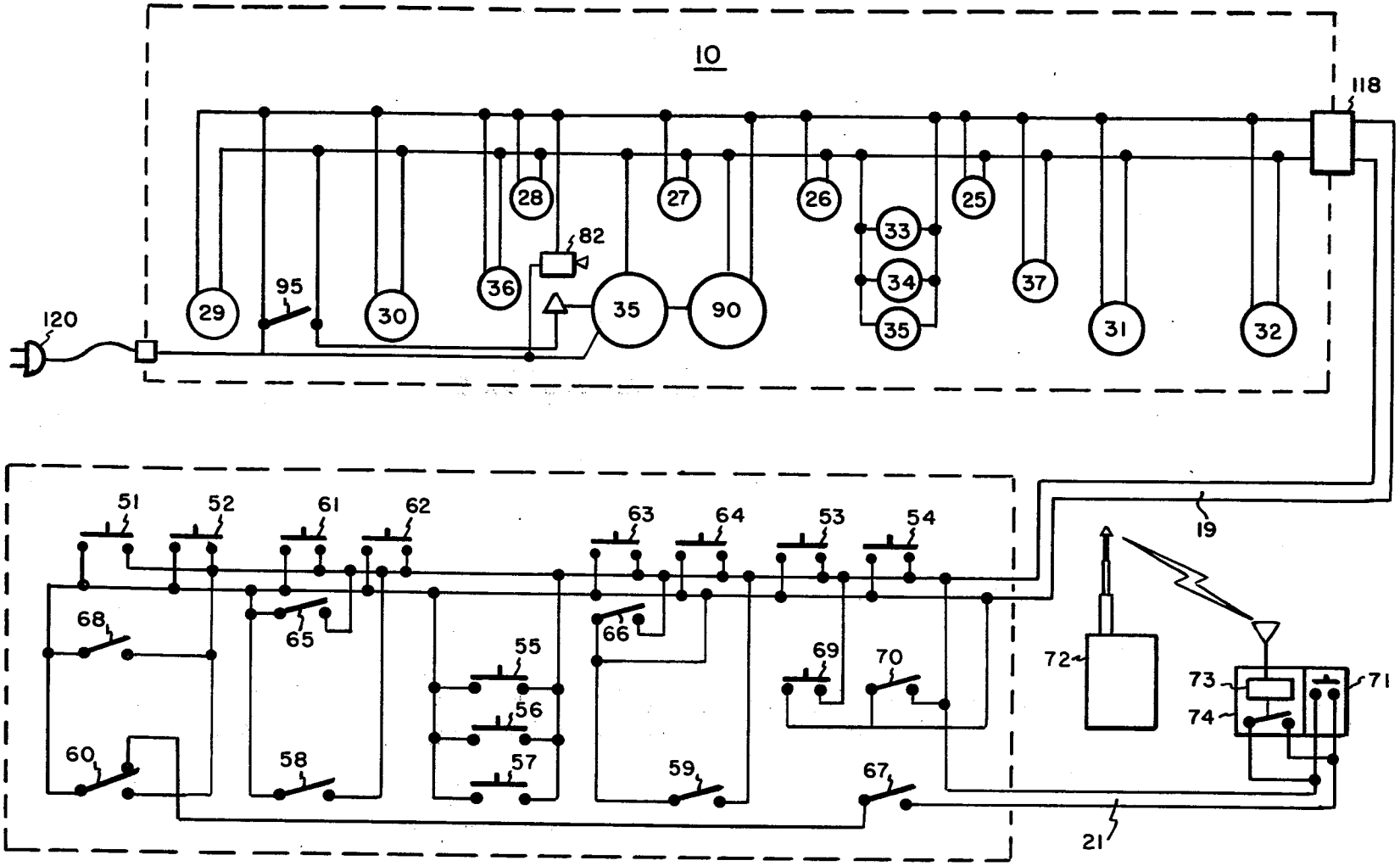
FIG. 17 is a control diagram for interconnecting the scoreboard and the control box.
Figure 18:
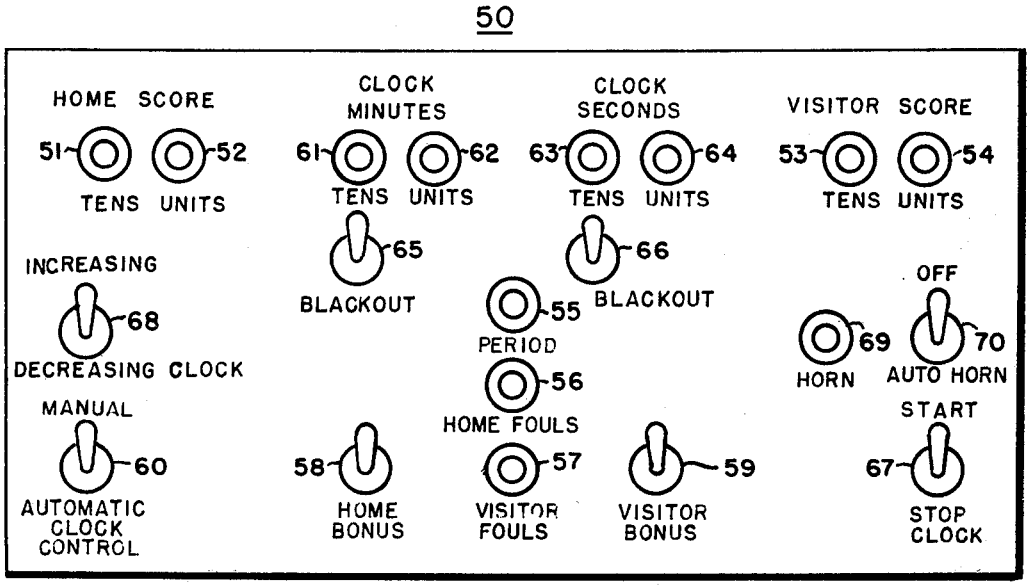
FIG. 18 is a front view of the control box for the portable scoreboard.

Referring now to FIG. 18 there is shown a control box 50 for operating scoreboard 10. As shown in FIG. 17, control box 50 is connected to all purpose portable scoreboard 10 through control cable 19. Power is provided for portable scoreboard 10 and the control box 50 from a plug connection to an electrical outlet. Power can also be provided from a portable generator when an electrical outlet is not conveniently available. The face of the control box is as shown in FIG. 18. Push button 51 controls numeral 29. Push button 52 controls numeral 30. Push button 53 controls numeral 31 and push button 54 controls numeral 32. These push buttons 51 through 54 can be used for changing the home and visitor scores. Push button 55 controls the lights 33 to the right of the quarter indication shown in FIG. 1. As push button 55 is depressed the quarter lights 33 are sequentially lit until they are all lit, further depressing of push button 55 extinguishes all lights and their cycle can be repeated. Push button 56 controls the lights 34 to the right of the home foul indication as shown in FIG. 1. Push button 57 controls the lights 35 to the right of the visitors foul indication shown in FIG. 1. Toggle switches 58 and 59 control the home and visitors bonus lights 36 and 37. Toggle switch 60 controls operation of the numeral displays 25 through 28. When toggle switch 60 is in the manual (MAN.) position, numeral display 28 is controlled by push button 61, numeral display 27 is controlled by push button 62, numeral display 26 is controlled by push button 63, and numeral display 25 is controlled by push button 64. Toggle switch 65 is used for blacking out numeral display 28 and toggle switch 66 is used for blacking out numeral display 26 when not required. When toggle switch 60 is in the automatic (AUTO) position numerals 25 through 28 respond to an internal clock. The clock can be started or stopped by toggle switch 67. The digital clock indications are provided by numeral displays 25 through 28. The clock can be made to be increasing or decreasing by positioning switch 68. Operation of the start-stop clock toggle switch 67 can be provided by parallel contacts which are responsive to a remote control operator. Push button 69 provides manual operation of the horn. Toggle switch 70 controls automatic operation of the horn.

Referring now to FIG. 17 there is shown a control diagram of control box 50 and scoreboard 10. The remote push button 71 is provided for start-stop operation of the clock. Start-stop operation of the clock can also be controlled by transmitter 72 through receiver 73 and controlled contacts 74. Transmitter 72 and receiver 73 can be of the type as is commonly used for controlling operation of an automatic garage door opener. Transmitter 72 can be carried by field personnel for remote control of the scoreboard clock, numeral displays 25 through 28. A multi-conductor control cord 19 extends from control box 50 to scoreboard 10. A receptacle and plug combination 118 are provided for connecting control cord 19 to scoreboard 10. A plug 120 is provided on scoreboard 10 for connecting to an external power supply. A control cord 21 extends between control box 50 and the remote start-stop push button 71.

Figure 23:
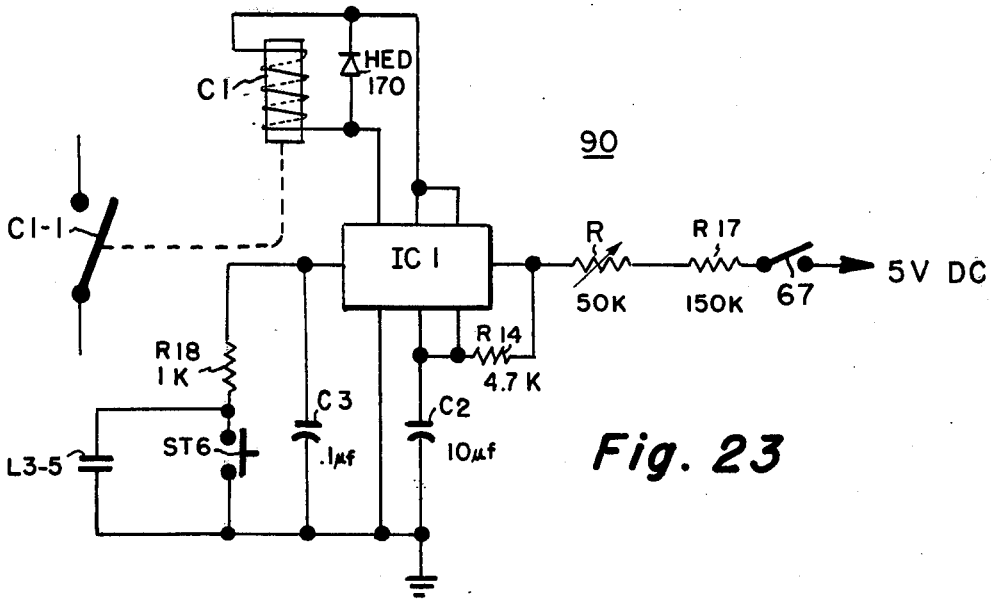

Referring now to FIG. 23 there is shown a timing circuit 90 which when activated by pressing the start button, 67, supplies 12 volt pulses at 1 second intervals to activate contacts C1-1. A fast count start contact ST6 is also provided for causing circuit 90 to supply pulse at 10th of a second intervals. The output of timing circuit 90 is utilized as more fully described hereinafter.

Figure 19:
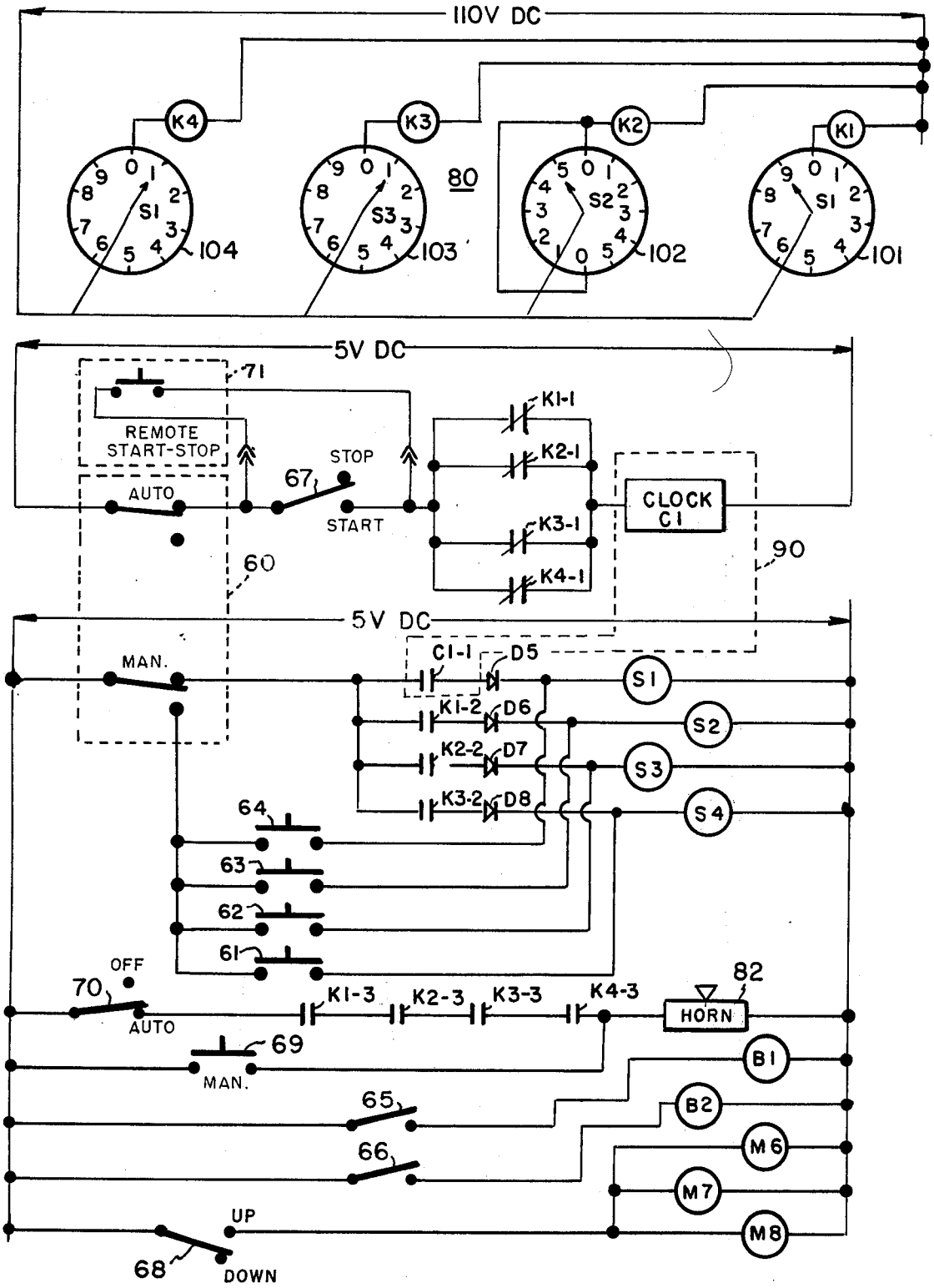
FIG. 19 shows the master clock circuit used in the disclosed portable scoreboard.

Referring now to FIG. 19 there is shown a master control circuit 80 for controlling scoreboard 10 display numerals 25 through 28 as a clock. The clock is most often used to display remaining time and this is the way the stepping devices switches 101 through 104 are represented. That is, the rotating indicator in each stepping device should be considered to be moving by steps in the counterclockwise direction. Stepping devices 101 through 104 can be stepper switches or other devices which sequentially change their output as they are repeatedly energized. When all stepper switches 101 through 104 count down to an all zero indication, 00:00, the clock will be stopped indicating the alloted time has elapsed. Switch 68 controls the coils M6, M7 and M8 of the contactors shown in FIG. 21 for reverse counting direction of the numeral indicators 25 through 28. Four stepping devices 101, 102, 103 and 104 are provided which step each time power is supplied to and removed from their input. Stepping device 101 provides an indication in seconds. Stepper switch 102 provides an indication in tens of seconds. Stepper switch 103 provides an indication in minutes. Stepper switch 104 provides an indication in tens of minutes. The pulse counter 90 shown in detail in FIG. 23 8 operates relay C1 at 1 second intervals. Contact C1-1 which is controlled by relay C1 is used for switching power to the coil, S1, of stepper switch 101. The timing rate of stepping switch 101 through 104 is necessarily determined by the switching rate of contact C1-1 which is controlled by timer circuit 90 to be one second during normal operation. With switch 67 in the start position and contact K1-1, K2-1, K3-1, or K4-1 closed, clock relay C1 opens and closes contact C1-1 once every second which operates the coil S1 of stepper switch 101. Stepper switch 101 thus steps around at 1 second intervals. As stepper switch S1 steps around at 1 second intervals, numeral 25 changes in synchronism on scoreboard 10. At each 10 second interval, stepper switch 101 comes to the zero upright position energizing relay K1. When relay K1 is energized contact K1-2 closes energizing the stepping device coil S2 which controls stepper switch 102 through 1 step. Thus for every 10 steps of stepper switch 101, stepper switch 102 is stepped one time. Stepper switch 102 thus controls the tens of second intervals shown on numeral display 26. Stepper switch 102 is a 12 position stepper switch and has take offs at the 12 o'clock and 6 o'clock position to relay K2. Thus after every 6 steps, stepper switch 102 will activate minute stepper switch 103, through the contacts K2-2 of relay K2, to step one step. Stepper switch 102 pulses stepper switch 103 after every 60 second interval through energizing relay K2. When contactor K2 is energized, by stepper switch 102 being in the zero position, contact K2-2 is closed energizing the coil S3 of stepper switch 103, moving stepper switch 103 one interval. Stepper switch 103 is a 10 position stepper switch and thus after every 10 interval steps of stepper switch 102 will count minute intervals. The minutes are shown on numeral display 27. Stepper switch 103 steps stepper switch 104 through relay K3 and contacts K3-3. When stepper switch 103 is at the zero upright position relay K3 is energized and the associated contact K3-2 is closed energizing the coil S4 of stepper switch 104. This steps stepper switch 104 one step. Stepper switch 104 thus steps at 10 minute intervals. The tens of minutes are indicated by numeral display 27. Diodes D5, D6, D7 and D8 are provided in series with the contacts C1-1, K1-2, K2-2 and K3-2 to provide isolation.

In operation with the master clock circuit 80 counting down initial time is selected and manually set by push buttons 61, 62, 63 and 64 and shown by numeral displays 25 through 28. When horn control switch 70 is set in the auto position after stepping devices 101, 102, 103 and 104 have all moved to the zero upright position, providing an all zero, 00:00, indication on numeral indicating modules 25 through 28, horn 82 sounds. When stepper switches 101, 102, 103 and 104 are all in the zero upright position, relays K1, K2, K3 and K4 are all energized closing their associated contacts K1-3, K2-3, K3-3 and K4-3, respectively. When contacts K1-1, K2-3, K3-3 and K4-3 are closed, horn 82 is activated. Horn 82 can be activated any time by depressing push button 69 which completes the circuit to sound the horn. When the automatic horn switch 70 is in the off position, horn 82 is not activated through the associated stepper switches 101, 102, 103 and 104.

Stepper switches 101, 102, 103 and 104 and their associated numeral indications 25, 26, 27 and 28 respectively, can all be operated manually at any time through the associated manual operating switches 64, 63, 62 and 61, when switch 60 is in the manual position. When switch 60 is in the automatic position, manual operating switches 61 through 64 do not control operation of stepping switches 101 through 104 and their associated numeral indications 25 through 28. With switch 60 in the manual position, switches 61 through 64 allow the numerals associated with each stepper switch to be rapidly set to any desired position. With switch 60 in the automatic position and timer control 67 or 71 closed, the clock circuit 90 is activated through contacts K1-1, K2-1, K3-1 or K4-1. Clock relay C1 operates clock contact C1-1 controlling stepper switches 101 through 104 as described above. When each stepper switch 101 through 104 is in the zero position energizing its associated relay K1, K2, K3 or K4, the associated contact K1-1, K2-1, K3-1, or K4-1 is open. Since these contacts K1-1, K2-1, K3-1, and K4-1 are disposed in parallel until they are all simultaneously open, power is being supplied to clock C1. When stepper switches 101 through 104 are all providing a zero indication on indicator display lights 25 through 28, relays K1, K2, K3 and K4 are energized interrupting power to clock circuit 90 disabling the clock contact C1-1. Thus, during timing down when the numeral indicators reach an output of all zeros the clock C1 is disabled. Switch 68 controls whether the clocking numerals 25 through 28 count up or count down. With switch 68 in the down position relays to M6, M7 and M8 are deenergized and the associated contacts are moved to their deenergized position shown in FIG. 21. Switches 65 and 66 control relays B1 and B2, respectively, which when activated black out numeral displays 26 and 28, respectively. When switch 68 is in the up position, relays M6, M7 and M8 will be energized and the clock will count up.

Referring now to FIG. 21 there is shown a circuit 100 for activating a typical numeral light module which is clock controlled. FIG. 21 shows stepper switch 104 controlling numeral light display module 28 which provides tens of minutes indication. The stepper switch 104 is in the 3 position and the number displayed by the numeral display 28 is a 3. In FIG. 21, relays M6, M7 and M8 are shown in their deenergized position for counting down. During normal down counting the clock circuit functions to provide an indication of remaining time. At 10 minute intervals, stepper switch 104 is stepped counterclockwise around switch 104 changing the number displayed on numeral light module 28. As stepper switch 104 is in any of the positions, 0 through 9, power is applied to the corresponding input 0 through 9, of numeral display light module 28 which provides the desired number output. When it is desired to count up, switch 68 is closed energizing relays M6, M7 and M8 causing the interconnections between stepper switch 104 and the input to numeral display 28 to be changed so that as stepper switch 104 continues to turn in a counterclockwise direction the numbers displayed are counted up. That is with relays M6, M7 and M8 energized and stepper switch 104 in the 0 position 9 is indicated, when in the 1 position an 8 is indicated, when in the 2 position a 7 is indicated, when in the 3 position a 6 is indicated, when in the 4 position a 5 is indicated, when in the 5 position a 4 is indicated, when in the 6 position a 3 is indicated, when in the 7 position a 2 is indicated, when in the 8 position a 1 is indicated and when in the 9 position a 0 is indicated. Thus by energizing relays M6, M7 and M8 the direction in which the clock controlled numeral displays 25 through 28 count can be changed. Numeral light module 28 is formed from an array of incandescent lamps 110. Power is supplied to the appropriate inputs and the desired number is displayed. Power is supplied from a full wave bridge rectifier 135 comprising diodes D10, D11, D12 and D13. These provide a DC output from the alternating current input. The value of the DC output can be changed from around 96 volts DC to approximately 110 volts DC by closing switch 95 which inserts capacitor C10 across the DC output of the full wave bridge rectifier 135. Insertion of capacitor C10 increases the level of output voltage to approximately 110 volts DC. For indoor operation switch 95 is normally in the open position and lamps 110 are operated at a reduced voltage. This provides for long life and proper brightness for indoor viewing. For use outdoors or when the background is brighter, the light intensity of lamps 110 is increased by closing switch 95 which increases the voltage supplied to lamps 110. This increased voltage greatly increases the brightness of lamps 110 and provides for easy viewing even in direct sunlight.

Light display modules 25 through 28 can be either operated by the clock or manually. When manually operated it is desirable that numerals 26 and 28 be blacked out when not in use. Switches 65 and 66 are provided for blacking out these numerals. As shown in FIG. 21 a contact B1-1 is operable in response to the energizing of relay B1. By closing switch 65, B1-1 opens and light module 28 is blacked out. During clock control these numeral light display modules 26 and 28 will not be blacked out. Numeral display modules 29 and 31 which are only manually controlled are provided with an automatic black out for a zero indication. Control for the numeral light modules 29, 30, 31 and 32 which are not clock controlled are similar to those shown in FIG. 21 but without relays M6, M7 and M8 which are used for changing the direction of counting.

Figure 20:
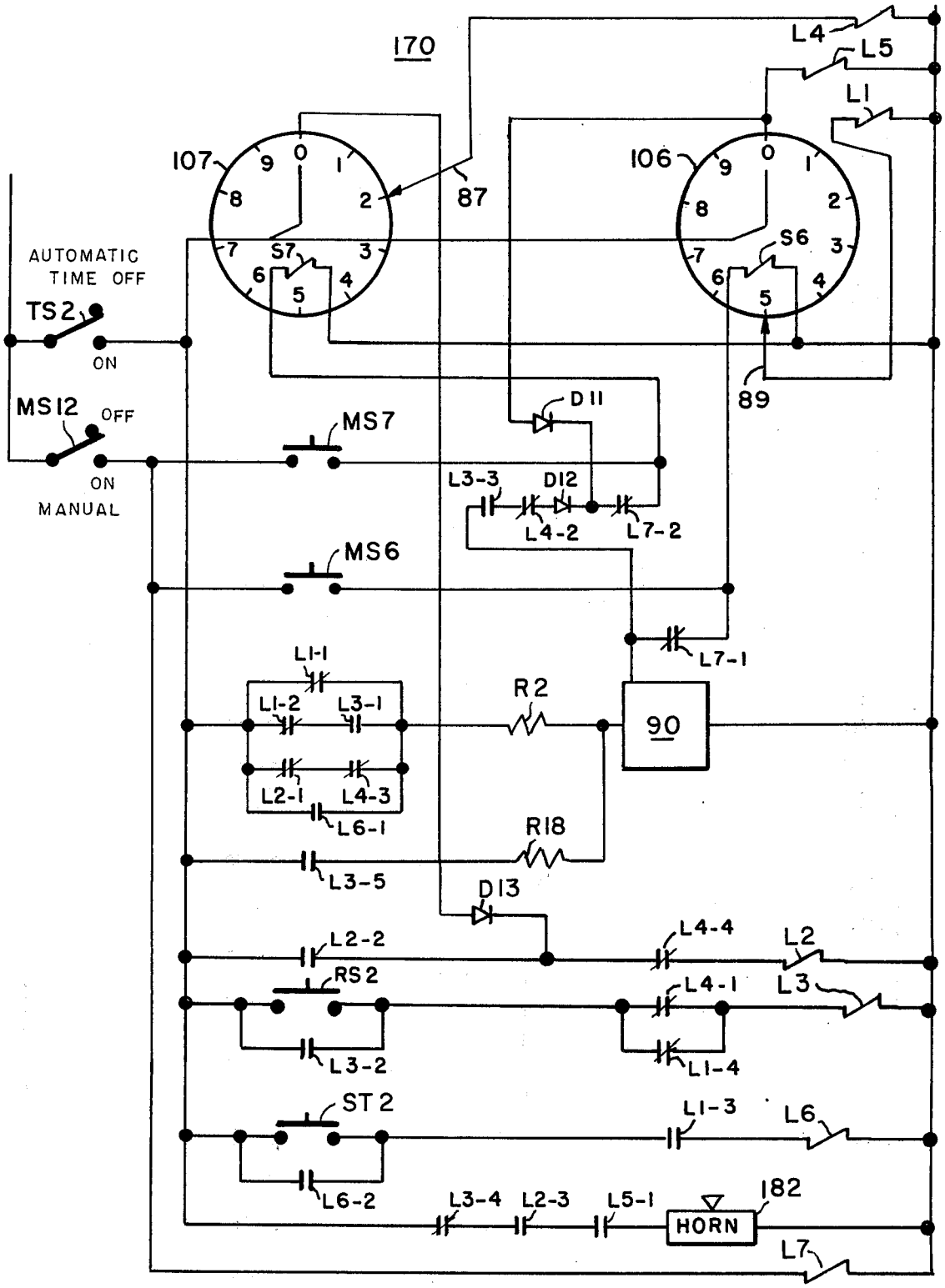
FIG. 20 is a schematic of the adjustable 1 to 99 second timer circuit used in the short period timer.

Referring now to FIGS. 20 and 22 there is shown a short interval timing clock circuit 170. This clock is adapted to countdown to zero at which time a horn 182 sounds. The clock is adjustable from 1 to 99 seconds. The clock can be used as a shot clock timer for womens basketball (30 sec.), half court timer (10 sec.), international basketball (30 sec.), professional basketball (24 sec.) or as a game delay clock in football (25 sec.). A pair of these timers can be utilized in conjunction with the scoreboard and placed at either end of the playing field or court. FIG. 20 shows a circuit 170 for automatic operation of the short interval timer 171. The circuit shown in FIG. 20 is set at a time interval of 25 seconds. Closing switch TS2 provides for automatic operation of the clock circuit and time display. Depressing start timing button ST2 starts the 25 second timing interval. The start of the timer interval set on stepper switches 106 and 107 can be reset at any time by depressing reset push button RS2. The start push button ST2 must again be depressed to start the timed interval after reset. Switches 106 and 107 are stepper switches which move one step each time the associated coil S6 or S7 is energized. Stepper switches 106 and 107 are ten position stepper switches. When counting stepper switch 106 is energized at 1 second intervals. At the end of each 10 second period each time stepper switch 106 is in the zero position it pulses the control coil of stepper switch 107 through diode D11 and contacts L7-2. Thus the combination of stepper switch 106 and 107 can provide timed intervals of 1 to 99 seconds, as set. During timing operation clock circuit 90, through contacts L7-1, steps stepper switch 106 once every second. For manual stepping of numerals controlled by the stepper switches 106 and 107, manual switch MS12 is moved to the on position and the numbers can now be changed one digit each time the associated manual control switches M6 and M7 are depressed. When operating in the automatic mode as stepper switch 106 and 107 both stop at the zero position horn 182 is sounded. Horn 182 sounds when relays L2 and L5 are energized picking up contacts L2-3 and L5-1. Contact L3-4 is controlled by relay L3 and is normally closed except when the automatic timing circuit is being reset, and at this time the horn 182 is disabled. Depressing the timing start button TS2 starts the timing interval. Depressing reset button RS2 energizes relay L3 which picks up contact L3-2 sealing itself in through parallel contacts L4-1 and L1-4 which are normally closed. Relay L4 is energized when stepper switch 107 is at the position indicated by selector 87, which is 2 in FIG. 20. During reset when contactor L3 is energized normally open contact L3-5 is closed completing a circuit through resistor R18 to timer circuit 90, causing timer circuit 90 to pulse at tenth of a second intervals. Contacts L3-5 are connected in parallel with the fast time switch ST6 on the timing circuit 90 shown in FIG. 23. Stepper switch 107 is rapidly moved to the position set by selector 87, as rapid timing pulses are applied through contacts L3-3, L4-2, isolating diodes D12 and contact L7-2. When stepper switch 107 reaches the position set by selector 87, contactor L4 is energized opening normally closed contact L4-2. This maintains stepper switch 107 at an indication as set by selector 87 shown in FIG. 20. Rapid timing pulses are simultaneously applied to stepper switch 106 through normally closed contacts L7-1. When stepper switch 106 reaches the position set by selector 89, relay L1 is energized opening contact L1-4 which is in parallel with now open contact L4-1 and this deenergizes relay L3. Deenergizing relay L3 opens contacts L3-5 disabling timer circuit 90 from rapid pulsing. Timing circuit 90 will again start pulsing at one second intervals when start push button ST2 is pressed energizing relay L6. Selectors 87 and 89 can be set on the associated stepper switches 107 and 106, from 0 to 9, thus it is possible to set in a timed interval from 1 to 99 seconds. At any time during this interval, the interval can thus be seen that circuit 171 provides a short timer which can be set from 1 to 99 seconds and can at any time be reset to the value set on the timer. The adjustability of this timer permits it to be used for a variety of sporting events which require timed intervals. Timing circuit 170 will time out and sound horn 182 when 00 is provided.

This invention thus teaches an all purpose portable convertible scoreboard. This scoreboard not only provides the versatility of converting for use in all major sports events in minutes and seconds, but is also completely self-contained and portable as described above. This scoreboard is usable indoors and outdoors. The disclosed scoreboard has large easily visible number displays and can function as back up for existing permanently mounted scoreboards. The high brilliance lights when used outdoors provide for visibility at extended distances of over 500 feet. The scoreboard clock can also be started and stopped remotely by an official on the field. Adjustable short interval timers can also be used in conjunction with the scoreboard.

What is claimed is:

1. A portable scoreboard comprising:

a self-contained carrying case:

a display face formed on a portion of said self-contained carrying case;

a first plurality of numeral displays each capable of displaying a number from zero to nine when activated by an appropriate input signal;

a second plurality of numeral displays each capable of displaying a number from zero to nine when activated by an appropriate input signal and each being manually and individually controllable;

control circuit means, for activating each of said first plurality of numeral displays comprising, up counting means which when activated causes said control circuit means to change said first plurality of numeral displays as a function of time from an initial value to a higher value, down counting means which when activated causes said control circuit means to change said first plurality of numeral displays as a function of time from a starting value to a lower value, and manual control means which when activated permits said first plurality of numeral displays to be changed manually and individually.

2. A portable scoreboard as claimed in claim 1 comprising:

light intensity control means connected to said plurality of numeral displays for changing the light intensity of the numbers shown by said numeral display.

3. A portable scoreboard as claimed in claim 2 comprising:

a plurality of descriptive placards attachable as desired to said display face permitting the scoreboard to be used for a multiplicity of sports.

4. A portable scoreboard as claimed in claim 3 wherein said plurality of descriptive placards comprises:

a first set of descriptive placards attachable to said display face to render the portable scoreboard usable for basketball;

a second set of descriptive placards attachable to said display face to render the portable scoreboard usable for football;

a third set of descriptive placards attachable to said display face to render the portable scoreboard usable for baseball;

a fourth set of descriptive placards attachable to said display face to render the portable scoreboard usable for track;

a fifth set of descriptive placards attachable to said display face to render the portable scoreboard usable for swimming;

a sixth set of descriptive placards attachable to said display face to render the portable scoreboard usable for hockey; and, a seventh set of descriptive placards attachable to said display face to render the portable scoreboard usable for wrestling.

5. A portable scoreboard comprising:

a scoreboard face having a plurality of variable numeral indicators;

clock control means for controlling some of said plurality of variable numerals to function as a clock which can count up and count down;

black out means for blacking out selected numeral indicators;

manual control means for controlling all of said plurality of variable numerals manually; and a plurality of attachable placards, containing descriptive designations thereon, combinations of which can be attached to the portable scoreboard for rendering the scoreboard usable for a variety of sports.

6. A portable scoreboard as claimed in claim 6 comprising:

a plurality of indicator lights formed on the scoreboard face; and wherein, with some of said placards attached for a selected sport they selectively reveal at least some of said plurality of indicator lights for the appropriate sport.

7. A portable scoreboard as claimed in claim 5 comprising:

a control box containing said manual control means;

a control cable for connecting said control box to said scoreboard face;

a self-contained carrying case for containing the complete scoreboard having compartment means formed therein for receiving said placards, said control box and said control cable;

said self-contained carrying cases comprises, a first unit having a generally rectangular portion of a scoreboard face, a second unit having a generally rectangular portion of scoreboard face and being pivotally connected to said first unit at one end; and each unit being pivotal between a closed position wherein the generally rectangular scoreboard faces are juxtaposition, and an open position, wherein the generally rectangular scoreboard faces lie in generally the same plane.

8. A portable scoreboard as claimed in claim 5 comprising:

brightness control for changing the brightness of said plurality of variable numeral indicators.

9. A portable scoreboard as claimed in claim 5 wherein:

four of said plurality of variable numeral indicators form a clock showing minutes and seconds;

said black out means is usable for blacking out the tens of minutes and tens of second indicators of said four variable numeral indicators which form the clock; and comprising, a horn which can be sounded manually and automatically when the clock reaches a predetermined indication.

10. A portable scoreboard as claimed in claim 5 comprising:

remote control means operably connected, but not physically attached, to said clock control means for remote control of said clock control means.

11. A portable scoreboard as claimed in claim 5 comprising:

a short interval timer adjustable from 1 to 99 seconds associated with the scoreboard;

a start timing control for starting said short interval timer running;

a stop timing control for stopping said short interval timer; and a reset for resetting said short interval timer to the start of the timer interval set.

12. A portable scoring apparatus usable for a variety of sports comprising:

a first plurality of variable numerical displays for indicating selected one digit numbers;

automatic control means for operating said first plurality of variable numerical indicators as a clock which can count up and count down;

selector means connected to said automatic control means for selecting either up counting or down counting;

a second plurality of variable numerical displays for indicating selected one digit numbers;

manual control means for controlling said first and second plurality of variable numerical displays manually; and, placard means containing descriptive material attachable to the scoreboard for adapting the scoreboard for use with a variety of sports.

13. Portable scoring apparatus as claimed in claim 12 comprising:

brightness control means conected to said first and second plurality of variable numerical displays for altering the brightness of the numbers displayed.

14. Portable scoring apparatus as claimed in claim 13 comprising:

black out means for selectively blacking out some of said first plurality of variable numerical displays.

15. Portable scoring apparatus as claimed in claim 14 comprising:

a control box for controlling said plurality of indicator lights and said first and second plurality of variable numerical displays;

a housing formed from two units hinged together and being movable to an open position forming a relatively flat scoreboard face wherein said plurality of indicator lights and said first and second plurality of variable numerical displays are visible and a closed position forming a carrying and storage case;

control cable connecting said control box to said housing; and storage area formed in said housing for storing said control box, said control cable and said placard means.

16. Portable scoring apparatus as claimed in claim 15 comprising:

a pair of adjustable short interval timers providing a digital display of the time remaining in a selected short timer interval;

a start for starting the selected interval; and a reset for resetting the selected short time interval to the beginning.

17. Portable scoring apparatus as claimed in claim 16 omprising:

a remote controller for controlling the operation of the clock.

18. A portable scoreboard as claimed in claim 17 wherein said placard means comprises:

a first set of cards usable to convert the scoreboard to scoring basketball;

a second set of cards usable to convert the scoreboard to scoring football;

a third set of cards usable to convert the scoreboard to scoring baseball.

* * * * *

UNITED STATES PATENT AND TRADEMARK OFFICE

CERTIFICATE OF CORRECTION

PATENT NO. : 4,045,788

DATED : August 30, 1977

INVENTOR(S) : Joseph T. Castelli, Joseph J. Forrester, Stephen Symosko

It is certified that error appears in the above-identified patent and that said Letters Patent are hereby corrected as shown below:

Column 11, line 28, the numeral "6" (second occurrence) should read --5--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*